United States Patent [19]

Strasinger

[11] Patent Number: 4,597,197

[45] Date of Patent: Jul. 1, 1986

[54] PERSONALIZED BOOT PULLSTRAP

[75] Inventor: David T. Strasinger, Nashville, Tenn.

[73] Assignee: The United States Shoe Corporation, Cincinnati, Ohio

[21] Appl. No.: 762,243

[22] Filed: Aug. 2, 1985

[51] Int. Cl.[4] ..... A43B 11/00; A43B 23/25

[52] U.S. Cl. ..... 36/56; 36/1; 36/136; 2/245; 2/338; 40/21 C

[58] Field of Search ..... 36/56, 136, 1; 2/245, 2/338; 40/21 R, 21 C

[56] References Cited

U.S. PATENT DOCUMENTS

| | | | |
|---|---|---|---|
| 250,766 | 12/1881 | Thompson | 36/56 |
| 331,927 | 12/1885 | Walden | 36/56 |
| 1,219,284 | 3/1917 | Freedman | 40/21 C |
| 1,220,468 | 3/1917 | Smith . | |
| 1,346,810 | 7/1920 | Decker . | |
| 2,285,751 | 6/1942 | Tamaki | 36/1 |
| 2,648,150 | 8/1953 | Sullivan | 40/21 C |
| 2,801,477 | 8/1957 | Adams et al. . | |
| 3,585,743 | 6/1971 | Jeffers . | |
| 3,848,270 | 11/1974 | Rand | 2/338 X |
| 4,144,594 | 3/1979 | Chapman | 2/338 |
| 4,340,976 | 7/1982 | Wright . | |

FOREIGN PATENT DOCUMENTS

| | | | |
|---|---|---|---|
| 2141 | 4/1890 | Sweden | 36/56 |

*Primary Examiner*—James Kee Chi

*Attorney, Agent, or Firm*—David H. Semmes; Warren E. Olsen

[57] ABSTRACT

Boots, particularly cowboy boots, having a looped pullstrap. A reinforced and welted pullstrap is personalized by the attachment of a pullstrap plate to the pullstrap exterior, such that a name panel insert may be inscribed with the wearer's name and affixed to the pullstrap plate.

4 Claims, 5 Drawing Figures

PERSONALIZED BOOT PULLSTRAP

CROSS-REFERENCES TO RELATED APPLICATIONS

A mechanical adaptation of the design illustrated in applicant's co-pending application Ser. No. 758,234 for a COWBOY BOOT PULLSTRAP, filed July 24, 1985.

BACKGROUND OF THE INVENTION (1) Field of the Invention

Boots, particularly cowboy boots of the type having a pull-strap secured to the boot top as an assistance in pulling the boot onto the wearer's foot.

(2) Description of the Prior Art

SMITH U.S. Pat. No. 1,220,468
DECKER U.S. Pat. No. 1,346,810
ADAMS U.S. Pat. No. 2,801,477
JEFFERS U.S. Pat. No. 3,585,743
WRIGHT U.S. Pat. No. 4,340,976

These patents are being discussed separately in an INFORMATION DISCLOSURE STATEMENT.

SUMMARY OF THE INVENTION

A personalized pullstrap for boots, particularly cowboy boots, comprising an elongated flat strip having its opposed ends adapted for folding in parallel to the bottom surface of the flat strip. One end of the flat strip is secured to the boot interior and the other end is secured to the boot exterior, so as to expose a pullstrap loop at the top of the boot. The pullstrap is modified by the attachment of a pullstrap plate which may include a personalized name panel insert and suitable ornamentation in the form of engraving or the like.

DESCRIPTION OF THE PREFERRED EMBODIMENTS

Figure 1:
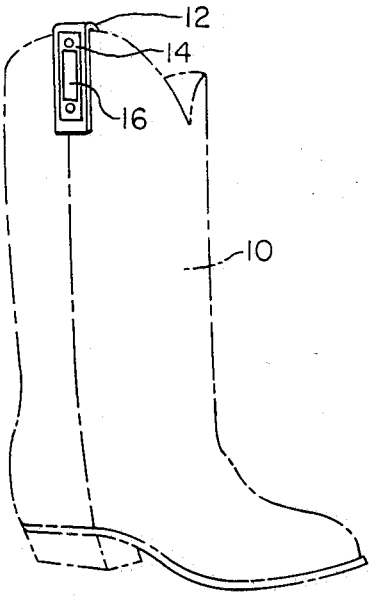
FIG. 1 is a perspective view of the pullstrap with its opposed ends affixed respectively to the inside and outside top of a cowboy boot (shown in phantom).

In FIG. 1, a conventional cowboy boot 10 is illustrated as having a pullstrap 12, to which is affixed pullstrap plate 14 and personalized name panel insert 16.

Figure 2:
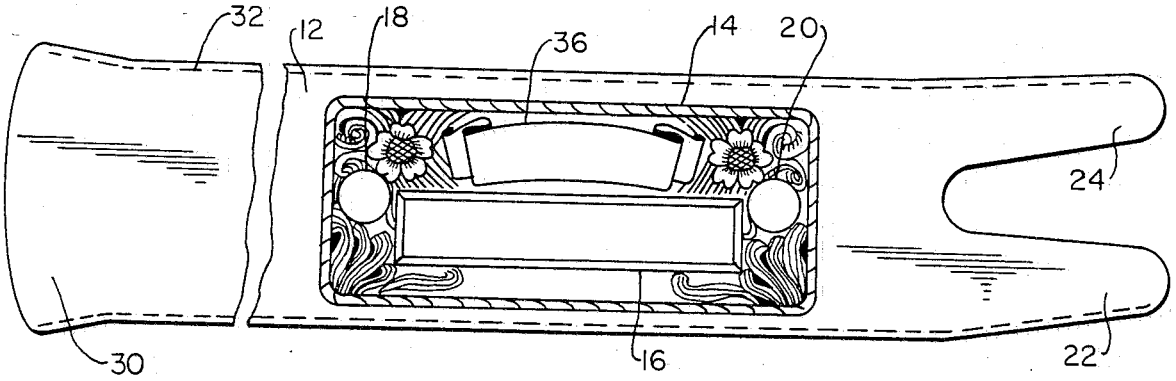
FIG. 2 is a fragmentary top plan of the pullstrap, showing its engraved pullstrap plate, as well as the bifurcated end and the widened end of the pullstrap.
Figure 4:
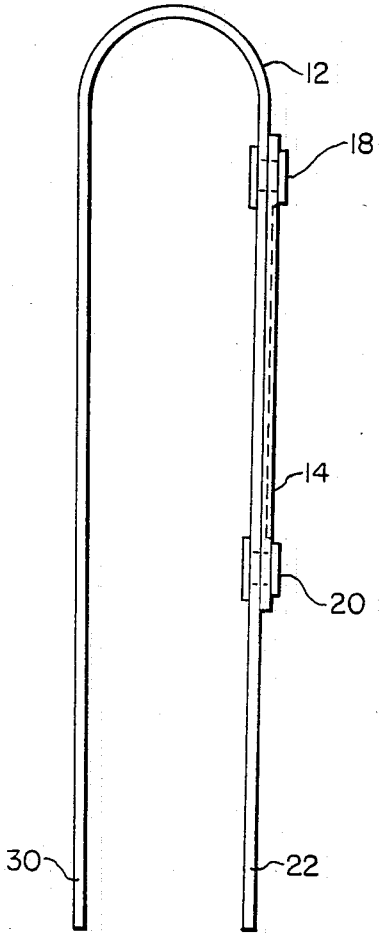
FIG. 4 is a side elevation, showing the doubling over of the pullstrap strip to form a looped pullstrap with the name panel being shown in dotted line.

As illustrated in FIG. 2, pullstrap 12 includes a shortened end, having bifurcations 22 and 24 for securement to the exterior of the boot, and a widened end 30 for securement within the inside of the cowboy boot top to form the pullstrap loop, illustrated in FIG. 4.

Figure 3:
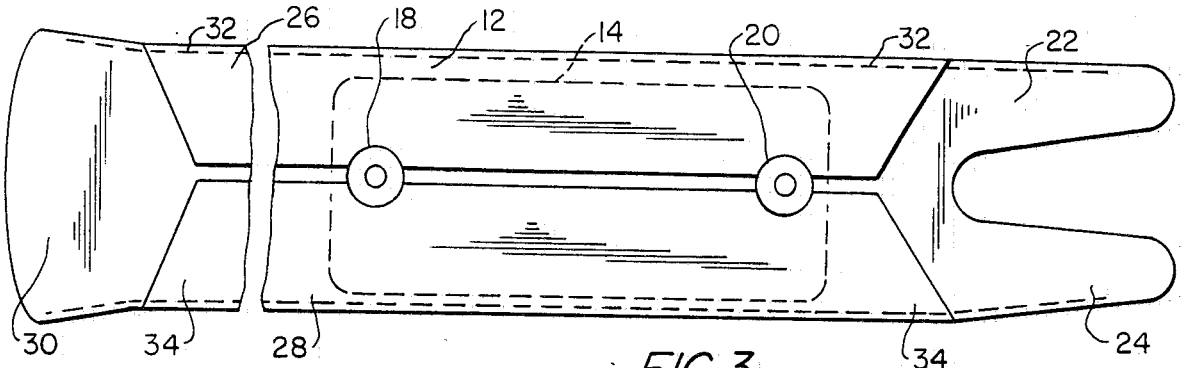
FIG. 3 is a fragmentary bottom plan, showing the turned under sides of the flat strip and the securement thereof by the widened heads of the rivets 18,20.

As illustrated in FIG. 3, pullstrap 12 may include turned under sides 26 and 28 which reinforce pullstrap 12 while the extremities of sides 26 and 28 form a channel enclosing pin or rivet shanks 18 and 20. The widened heads of rivets 18 and 20 may thereby abut the proximate extremities of turned under sides 26 and 28. As will be noted, the opposed ends of sides 26, 28 are cut back diagonally such that the bifurcated ends 22, 24 and the widened end 30 may flex freely for securement by any conventional means to the cowboy boot.

Figure 5:
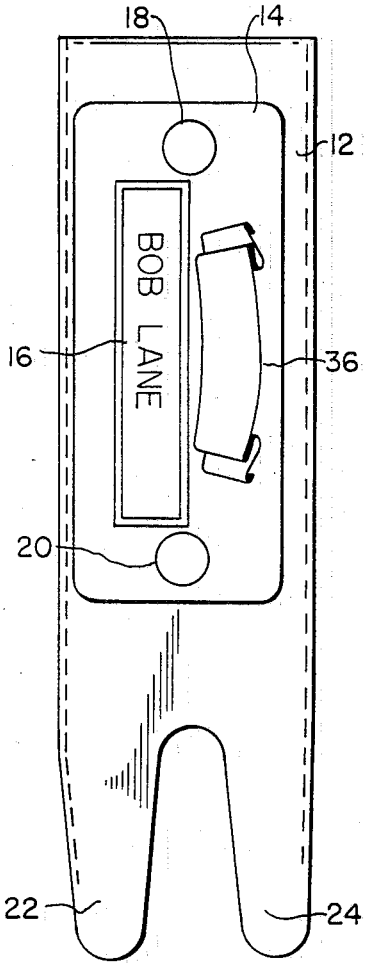
FIG. 5 is a front elevation of the pullstrap prior to folding under of bifurcations 22 and 24 for securement to the cowboy boot exterior.

As illustrated in FIGS. 2, 4 and 5, an engraved pullstrap plate 14 may include a floral design, including decorative banner 36, as well as a brass name panel insert 16.

As will be apparent, the boot wearer may thus personalize the pullstrap plate by having the name panel insert 16 engraved with his own name, such that panel 16 and the personalized name are exposed upon the exterior of the boot. Also, as illustrated in phantom in FIG. 4, pullstrap plate 14 may include a depressed, rectangular portion, so as to complementally support name panel 16.

Manifestly, the pullstrap plate may be cast or otherwise manufactured from various types of metals, plastics or the like, and the name panel may be of any suitable metal, plastic or other material.

I claim:

1. A personalized pullstrap for a boot comprising:

(a) an elongated flat strip having:

(i) turned under sides reinforcing the bottom surface of the strip, extremities of said turned under sides defining an open longitudinal channel;

(ii) opposed ends of the strip adapted for folding under and in parallel with the bottom surface of said strip;

(b) a pullstrap plate secured to the top surface of the strip by rivets extending through said plate, the strip and the strip channel, said rivets engaging extremities of the channel, said name panel forming a depression therein to confine a name plate insert;

(c) a personalized name plate insert attachable to the pullstrap plate within the depression thereof.

2. The personalized pullstrap for a boot according to claim 1 wherein said opposed ends define:

a first end bifurcated for flexible securement to the exterior of the boot in avoidance of a rivet; a second end widened for enhanced flexible securement to the interior of said boot; and wherein said turned under sides are cut back at each end to permit flexing of bifurcated and widened ends with respect to the flat surface of the strip.

3. A personalized pullstrap for a boot as in claim 2, the pullstrap including a stitched welt on either side extending from the first bifurcated end to the second widened end of the strap.

4. A personalized pullstrap for a boot as in claim 3, wherein said boot is a cowboy boot.

* * * * *